US010902766B1

(12) United States Patent
Wu et al.

(10) Patent No.: US 10,902,766 B1
(45) Date of Patent: Jan. 26, 2021

(54) APPARATUS FOR PERFORMING BRIGHTNESS ENHANCEMENT IN DISPLAY MODULE

(71) Applicant: HIMAX TECHNOLOGIES LIMITED, Tainan (TW)

(72) Inventors: Tung-Ying Wu, Tainan (TW); Tsai-Hsing Chen, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 16/904,527

(22) Filed: Jun. 17, 2020

(51) Int. Cl.
*G09G 3/20* (2006.01)
*G09G 3/36* (2006.01)

(52) U.S. Cl.
CPC ..... *G09G 3/2044* (2013.01); *G09G 3/3648* (2013.01); *G09G 2320/064* (2013.01); *G09G 2320/0653* (2013.01); *G09G 2320/0673* (2013.01)

(58) Field of Classification Search
None
See application file for complete search history.

(56) References Cited

U.S. PATENT DOCUMENTS

2020/0183239 A1* 6/2020 Yabuki ..... G09G 3/20
2020/0234662 A1* 7/2020 Yabuki ..... G09G 3/3648

* cited by examiner

*Primary Examiner* — Aneeta Yodichkas
(74) *Attorney, Agent, or Firm* — Winston Hsu

(57) ABSTRACT

A timing controller includes gamma correction (GC), line overdrive (OD) and dithering modules. The GC module performs GC on image data of an input image to convert the image data into gamma corrected data within a partial GC range of a predetermined GC range, the line OD module performs line OD on at least one portion of the gamma corrected data to convert the gamma corrected data into line-OD-processed data within a predetermined line OD range, and the dithering module performs dithering on the line-OD-processed data to convert the line-OD-processed data into dithered data within a predetermined dithering range. The timing controller drives a display panel to map first and second partial data of the dithered data into ordinary and extraordinary voltage ranges of the display panel, respectively, for displaying the dithered image while enhancing brightness. A display module including the timing controller, the display panel, etc. is also provided.

18 Claims, 10 Drawing Sheets

| Level | Red | Green | Blue |
|---|---|---|---|
| 1014 | 3741 | 3637 | 3184 |
| 1015 | 3744 | 3640 | 3187 |
| 1016 | 3747 | 3643 | 3190 |
| 1017 | 3749 | 3646 | 3192 |
| 1018 | 3752 | 3650 | 3195 |
| 1019 | 3755 | 3653 | 3197 |
| 1020 | 3756 | 3654 | 3198 |
| 1021 | 3756 | 3654 | 3198 |
| 1022 | 3756 | 3654 | 3200 |
| 1023 | 3800 | 3654 | 3229 |

FIG. 5

Current Data
Line OD Data
Previous Data

| | 0 | 240 | 480 | 720 | 960 | 1200 | 1440 | 1680 | 1920 | 2160 | 2400 | 2640 | 2880 | 3120 | 3360 | 3600 | 3840 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 240 | 256 | 240 | 232 | 224 | 216 | 208 | 200 | 192 | 184 | 176 | 168 | 160 | 152 | 144 | 136 | 128 | 120 |
| 480 | 512 | 497 | 480 | 464 | 448 | 432 | 415 | 399 | 383 | 367 | 351 | 335 | 318 | 302 | 286 | 270 | 254 |
| 720 | 768 | 754 | 738 | 720 | 695 | 671 | 646 | 622 | 597 | 573 | 548 | 524 | 499 | 475 | 450 | 426 | 401 |
| 960 | 1024 | 1011 | 996 | 980 | 960 | 927 | 894 | 861 | 827 | 794 | 761 | 728 | 695 | 662 | 629 | 595 | 562 |
| 1200 | 1280 | 1268 | 1255 | 1239 | 1221 | 1200 | 1158 | 1116 | 1074 | 1032 | 990 | 948 | 905 | 863 | 821 | 779 | 737 |
| 1440 | 1536 | 1525 | 1513 | 1499 | 1483 | 1463 | 1440 | 1389 | 1337 | 1286 | 1234 | 1183 | 1131 | 1080 | 1029 | 977 | 926 |
| 1680 | 1792 | 1782 | 1771 | 1758 | 1744 | 1726 | 1706 | 1680 | 1619 | 1557 | 1496 | 1438 | 1373 | 1312 | 1251 | 1189 | 1128 |
| 1920 | 2048 | 2039 | 2029 | 2018 | 2005 | 1990 | 1971 | 1948 | 1920 | 1848 | 1776 | 1704 | 1632 | 1560 | 1488 | 1416 | 1344 |
| 2160 | 2303 | 2296 | 2288 | 2278 | 2266 | 2253 | 2237 | 2217 | 2192 | 2160 | 2076 | 1992 | 1909 | 1825 | 1741 | 1657 | 1574 |
| 2400 | 2559 | 2553 | 2546 | 2537 | 2528 | 2516 | 2502 | 2485 | 2464 | 2436 | 2400 | 2303 | 2206 | 2109 | 2011 | 1914 | 1817 |
| 2640 | 2815 | 2810 | 2804 | 2797 | 2789 | 2779 | 2768 | 2753 | 2736 | 2713 | 2683 | 2640 | 2527 | 2414 | 2301 | 2187 | 2074 |
| 2880 | 3071 | 3067 | 3062 | 3057 | 3050 | 3042 | 3033 | 3022 | 3008 | 2989 | 2965 | 2931 | 2880 | 2746 | 2613 | 2479 | 2345 |
| 3120 | 3327 | 3324 | 3320 | 3316 | 3311 | 3305 | 3299 | 3290 | 3279 | 3266 | 3248 | 3222 | 3184 | 3120 | 2957 | 2793 | 2630 |
| 3360 | 3583 | 3581 | 3579 | 3576 | 3573 | 3569 | 3564 | 3558 | 3551 | 3542 | 3530 | 3513 | 3488 | 3445 | 3360 | 3144 | 2928 |
| 3600 | 3839 | 3838 | 3837 | 3835 | 3834 | 3832 | 3830 | 3827 | 3823 | 3819 | 3813 | 3804 | 3791 | 3770 | 3728 | 3600 | 3240 |
| 3840 | 4095 | 4095 | 4095 | 4095 | 4095 | 4095 | 4095 | 4095 | 4095 | 4095 | 4095 | 4095 | 4095 | 4095 | 4095 | 4095 | 3840 |

FIG. 6

APPARATUS FOR PERFORMING BRIGHTNESS ENHANCEMENT IN DISPLAY MODULE

BACKGROUND OF THE INVENTION

1. Field of the Invention

The present invention relates to display devices, and more particularly, to an apparatus for performing brightness enhancement in a display module, where examples of the apparatus may include a timing controller, the display module, etc.

2. Description of the Prior Art

According to the related art, a liquid crystal display (LCD) panel may be implemented to have dual-gate panel structure to achieve one or more goals such as cost reduction, etc. However, some problems may occur. For example, in a plurality of display units within one of these LCD panels, when a certain display unit in a certain line (e.g. row) of display units is displaying a lower gray level and an adjacent display unit in the next line (e.g. row) of display units is displaying a higher gray level, the adjacent display unit may be unable to achieve the higher gray level. Some suggestions in the related art have been proposed to try solving this problem, but these suggestions are not helpful on certain extreme cases. For example, when the lower gray level and the higher gray level are the minimum gray level (e.g. 0) and the maximum gray level (e.g. 255), respectively, these suggestions do not work. As a result, a summation of respective luminance values of a pure red image, a pure green image, and a pure blue image displayed on this LCD panel may be unequal to a luminance value of a pure white image displayed on the same LCD panel. Hence, there is a need for a novel method and associated architecture to enhance display control regarding spatial transition between gray levels of opposite extremes without introducing a side effect or in a way that is less likely to introduce a side effect.

SUMMARY OF THE INVENTION

It is an objective of the present invention to provide an apparatus for performing brightness enhancement in a display module, in order to solve the above-mentioned problems, where examples of the apparatus may include a timing controller, the display module, etc.

At least one embodiment of the present invention provides a timing controller, where the timing controller is applicable to performing brightness enhancement in a display module. The timing controller may comprise a brightness control circuit, and the brightness control circuit may comprise a gamma correction (GC) module, a line overdrive (OD) module coupled to the GC module, and a dithering module coupled to the line OD module. For example, regarding any color channel of multiple color channels, the GC module may perform GC on image data of an input image to convert the image data into gamma corrected data within a partial GC range of a predetermined GC range corresponding to said any color channel, for generating a gamma corrected image, wherein the partial GC range is smaller than the predetermined GC range; regarding said any color channel of the multiple color channels, the line OD module may perform line OD on at least one portion of the gamma corrected data of the gamma corrected image to convert the gamma corrected data into line-OD-processed data within a predetermined line OD range corresponding to said any color channel, for generating a line-OD-processed image; and regarding said any color channel of the multiple color channels, the dithering module may perform dithering on the line-OD-processed data of the line-OD-processed image to convert the line-OD-processed data into dithered data within a predetermined dithering range corresponding to said any color channel, for generating a dithered image. In addition, the timing controller may drive a display panel of the display module through one or more display drivers of the display module, to map first partial data and second partial data of the dithered data of the dithered image into at least one ordinary voltage range and at least one extraordinary voltage range of the display panel, respectively, for displaying the dithered image while enhancing brightness of the second partial data with said at least one extraordinary voltage range, where all gray levels of the second partial data are greater than that of the first partial data.

According to some embodiments, the present invention also provides the display module comprising the timing controller mentioned above, wherein the display module may further comprise the display panel and the one or more display drivers.

The present invention apparatus (e.g. the timing controller, the display module, etc.) can guarantee that any video input carrying an image having spatial transition between gray levels of opposite extremes will not make the display module suffer from brightness degradation problems. In addition, implementing the embodiments of the present invention does not significantly increase additional costs. Therefore, the related art problems can be solved, and the overall cost will not increase too much. In comparison with the related art, the present invention apparatus can enhance display control regarding spatial transition between gray levels of opposite extremes without introducing any side effect or in a way that is less likely to introduce a side effect.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 5 illustrates a digital gamma correction (DGC) range control scheme of the method shown in FIG. 2 according to an embodiment of the present invention.

FIG. 6 illustrates a two-dimensional (2D) look-up table (LUT) involved with the extreme brightness control scheme shown in FIG. 3 according to an embodiment of the present invention.

DETAILED DESCRIPTION

Figure 1:
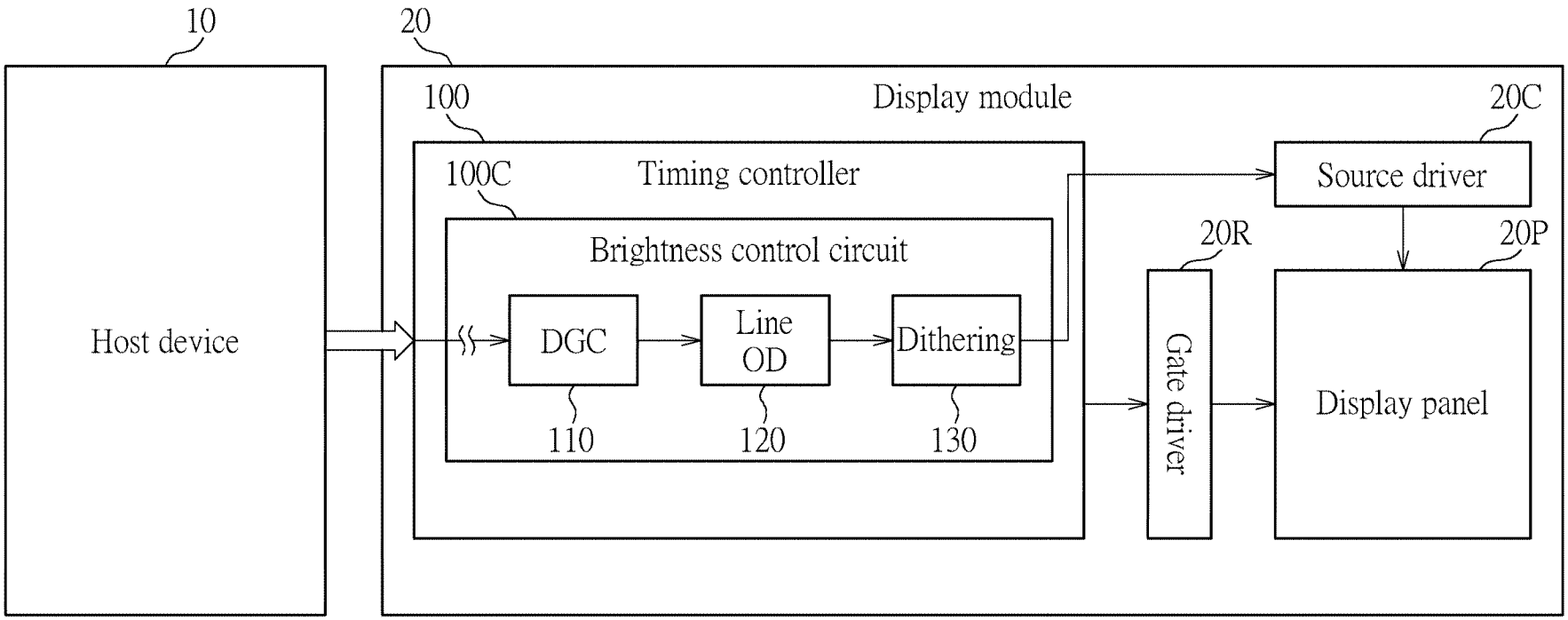
FIG. 1 is a diagram of a host system according to an embodiment of the present invention, where the host system may comprise a host device and a display module.

FIG. 1 is a diagram of a host system according to an embodiment of the present invention, where the host system may comprise a host device 10 and a display module 20, and the display module 20 may comprise a timing controller 100, at least one source driver (e.g. one or more source drivers) which may be collectively referred to as the source driver 20C, at least one gate driver (e.g. one or more gate drivers) which may be collectively referred to as the gate driver 20R, and a display panel 20P. For better comprehension, the host system shown in FIG. 1 may be implemented to be an electronic device such as a multifunctional mobile phone, etc., and the host device 10 may be arranged to control operations of the electronic device, where the display module 20 (e.g. the display panel 20P, etc. thereof) may represent an LCD module (e.g. an LCD panel, etc. thereof) implemented according to LCD technologies, but the present invention is not limited thereto. For example, the display module 20 may be one of other types of display modules implemented according to other technologies, and more particularly, the architecture thereof may vary when there is a need. In some embodiments, the host system shown in FIG. 1 may be implemented to be any of some other types of electronic devices.

The timing controller 100 may perform display control (e.g. perform timing control, image enhancement, etc.) on the display panel 20P through the source driver 20C and the gate driver 20R, and more particularly, may output associated display control signals to the source driver 20C and the gate driver 20R and output video signals to at least one of the source driver 20C and the gate driver 20R, for controlling the display panel 20P to display a plurality of images (e.g. image frames), but the present invention is not limited thereto. As shown in FIG. 1, the timing controller 100 may comprise a brightness control circuit 100C, and the brightness control circuit 100C may comprise multiple modules such as multiple sub-circuits. For example, the multiple modules of the brightness control circuit 100C may comprise a gamma correction (GC) module such as a digital gamma correction (DGC) module 110, a line overdrive (OD) module 120 and a dithering module 130 (respectively labeled "DGC", "Line OD" and "Dithering" for brevity), where the multiple modules may be implemented as sub-circuits of the brightness control circuit 100C, but the present invention is not limited thereto. The timing controller 100 is applicable to performing brightness enhancement in the display module 20, and more particularly, enhance display control regarding spatial transition between gray levels of opposite extremes, for example, by using the brightness control circuit 100C.

Based on the architecture shown in FIG. 1, the timing controller 100 may receive at least one video input such as one or more video input signals carrying a series of image data and associated control signals from the host device 10, for example, through a video input path between the host device 10 and the timing controller 100. For better comprehension, in a situation where the host system shown in FIG. 1 is implemented to be the electronic device such as the multifunctional mobile phone, etc., the video input path may comprise a flexible printed circuit (FPC) between the host device 10 and the display module 20, and comprise an interface circuit conforming to at least one specification, where the interface circuit may be positioned in the display module 20, and more particularly, in the timing controller 100, but the present invention is not limited thereto. According to some embodiments, the host device 10 and the display module 20 may be detachable, and the FPC may be replaced by a transmission cable such as a video input cable.

Figure 2:
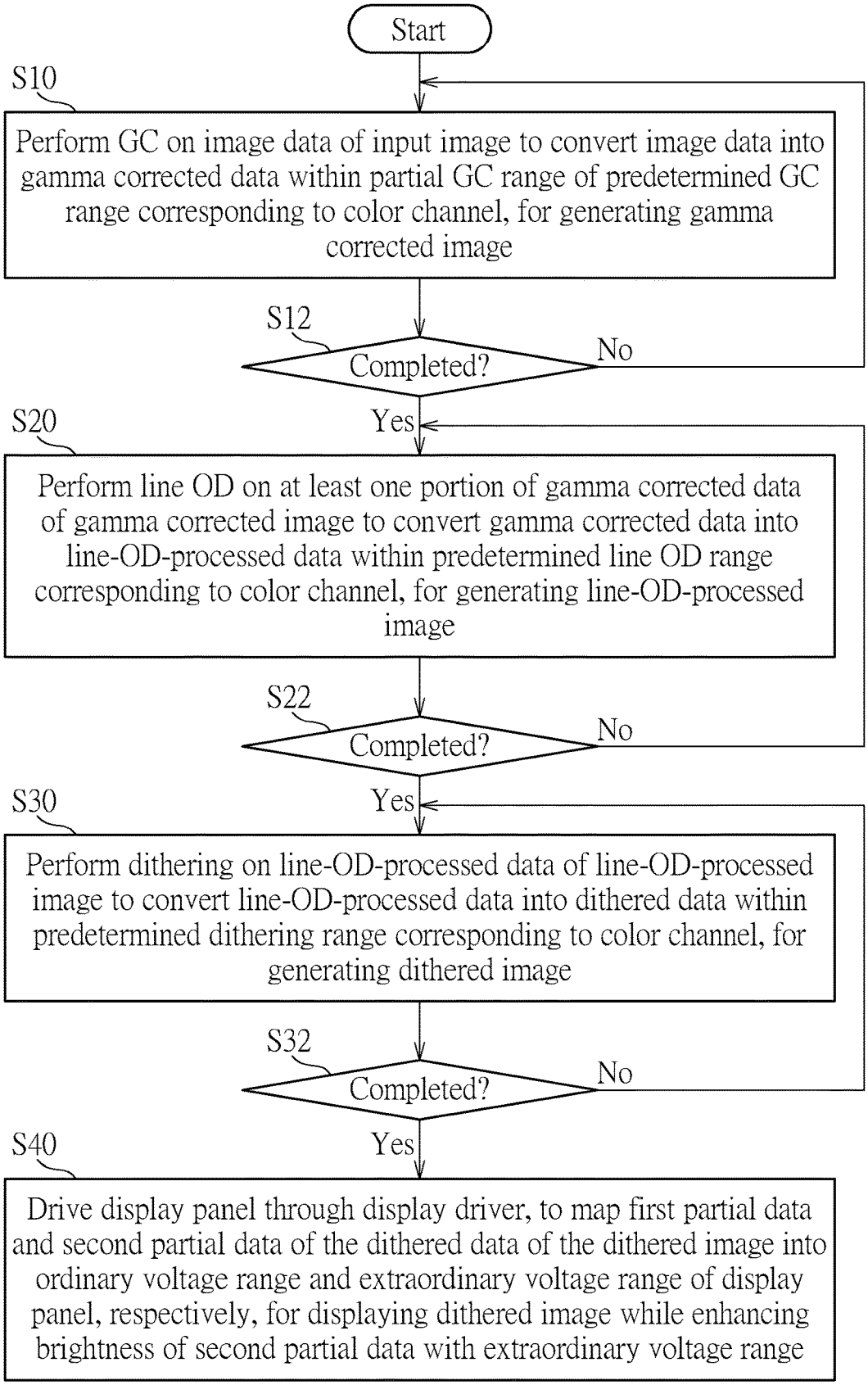
FIG. 2 is a flowchart of a method for performing brightness enhancement in a display module such as the display module shown in FIG. 1 according to an embodiment of the present invention.

FIG. 2 is a flowchart of a method for performing brightness enhancement in a display module such as the display module 20 shown in FIG. 1 according to an embodiment of the present invention. The working flow shown in FIG. 2 may be applied to the timing controller 100 (e.g. the brightness control circuit 100C, and more particularly, the components thereof).

In Step S10, regarding any color channel of multiple color channels (e.g. any of red (R), green (G) and blue (B) color channels), the timing controller 100 (e.g. the DGC module 110) may perform gamma correction (GC) on image data of an input image to convert the image data into gamma corrected data within a partial GC range of a predetermined GC range corresponding to said any color channel, for generating a gamma corrected image (e.g. an adjusted version of the input image), where the partial GC range is smaller than the predetermined GC range. For example, the input image may comprise multiple pixels, and each of the multiple pixels may comprise multiple sub-pixels respectively corresponding to the multiple color channels, such as R, G and B sub-pixels respectively corresponding to the R color channel, the G color channel and the B color channel, where any sub-pixel of the multiple sub-pixels may have a gray level GL(0) (e.g. an integer falling within a predetermined interval such as the interval [0, 1023]), but the present invention is not limited thereto.

For better comprehension, the image data corresponding to said any color channel (e.g. the R/G/B color channel) may comprise respective gray levels {GL(0)} of a set of sub-pixels corresponding to said any color channel (e.g. respective gray levels $\{GL_R(0)\}$ of a set of R sub-pixels corresponding to the R color channel, respective gray levels $\{GL_G(0)\}$ of a set of G sub-pixels corresponding to the G color channel, and respective gray levels $\{GL_B(0)\}$ of a set of B sub-pixels corresponding to the B color channel). In addition, the gamma corrected data corresponding to said any color channel (e.g. the R/G/B color channel) may comprise GC results such as respective gray levels {GL(1)} of the set of sub-pixels corresponding to said any color channel (e.g. respective gray levels $\{GL_R(1)\}$ of the set of R sub-pixels corresponding to the R color channel, respective gray levels $\{GL_G(1)\}$ of the set of G sub-pixels corresponding to the G color channel, and respective gray levels $\{GL_B(1)\}$ of the set of B sub-pixels corresponding to the B color channel). The gray levels {GL(0)} may be referred to as the original gray levels {GL(0)}, and the gray levels {GL(1)} may be referred to as the GC gray levels {GL(1)}.

In Step S12, the timing controller 100 (e.g. the DGC module 110) may determine whether the GC of all color channels for the input image is completed. If Yes, Step S20 is entered; if No, Step S10 is entered to perform the GC of the next color channel for the input image.

In Step S20, regarding said any color channel of the multiple color channels, the timing controller 100 (e.g. the line OD module 120) may perform line OD on at least one portion (e.g. a portion or all) of the gamma corrected data of the gamma corrected image to convert the gamma corrected data into line-OD-processed data within a predetermined line OD range corresponding to said any color channel, for generating a line-OD-processed image (e.g. an adjusted version of the gamma corrected image). For better comprehension, the line-OD-processed data corresponding to said any color channel (e.g. the R/G/B color channel) may comprise line-OD-processed results such as respective gray levels {GL(2)} of a set of sub-pixels corresponding to said any color channel (e.g. respective gray levels $\{GL_R(2)\}$ of a set of R sub-pixels corresponding to the R color channel, respective gray levels $\{GL_G(2)\}$ of a set of G sub-pixels corresponding to the G color channel, and respective gray levels $\{GL_B(2)\}$ of a set of B sub-pixels corresponding to the B color channel). The gray levels {GL(2)} may be referred to as the line OD gray levels {GL(2)}.

In Step S22, the timing controller 100 (e.g. the line OD module 120) may determine whether the line OD of all color channels for the gamma corrected image is completed. If Yes, Step S30 is entered; if No, Step S20 is entered to perform the line OD of the next color channel for the gamma corrected image.

In Step S30, regarding said any color channel of the multiple color channels, the timing controller 100 (e.g. the dithering module 130) may perform dithering on the line-OD-processed data of the line-OD-processed image to convert the line-OD-processed data into dithered data within a predetermined dithering range corresponding to said any color channel, for generating a dithered image (e.g. an adjusted version of the line-OD-processed image). For better comprehension, the dithered data corresponding to said any color channel (e.g. the R/G/B color channel) may comprise dithered results such as respective gray levels {GL(3)} of a set of sub-pixels corresponding to said any color channel (e.g. respective gray levels $\{GL_R(3)\}$ of a set of R sub-pixels corresponding to the R color channel, respective gray levels $\{GL_G(3)\}$ of a set of G sub-pixels corresponding to the G color channel, and respective gray levels $\{GL_B(3)\}$ of a set of B sub-pixels corresponding to the B color channel). The gray levels {GL(3)} may be referred to as the dithered gray levels {GL(3)}.

In Step S32, the timing controller 100 (e.g. the dithering module 130) may determine whether the dithering of all color channels for the line-OD-processed image is completed. If Yes, Step S40 is entered; if No, Step S30 is entered to perform the dithering of the next color channel for the line-OD-processed image.

In Step S40, the timing controller 100 may drive the display panel 20P through one or more display drivers such as the source driver 20C and the gate driver 20R, to map first partial data and second partial data of the dithered data of the dithered image into at least one ordinary voltage range (e.g. one or more ordinary voltage ranges) and at least one extraordinary voltage range (e.g. one or more ordinary voltage ranges) of the display panel 20P, respectively, for displaying the dithered image while enhancing brightness of the second partial data with the aforementioned at least one extraordinary voltage range, where all gray levels of the second partial data are greater than that of the first partial data. For example, the display module 20 and the display panel 20P may represent the LCD module and LCD panel thereof, respectively, and the aforementioned at least one ordinary voltage range and the aforementioned at least one extraordinary voltage range may be voltage ranges of data voltages provided by the aforementioned at least one source driver such as the source driver 20C.

According to this embodiment, a first brightness range corresponding to the aforementioned at least one ordinary voltage range may be less than a second brightness range corresponding to the aforementioned at least one extraordinary voltage range. Taking the LCD module as an example of the display module 20, the LCD panel of the LCD module may comprise a plurality of display units (e.g. R/G/B display units) for displaying sub-pixels (e.g. R/G/B sub-pixels) of an image to be displayed, respectively, and the transparency of a liquid crystal (LC) layer at a certain display unit of the plurality of display units may be controlled by a data voltage applied to this display unit, where the data voltage may be one of the data voltages, and may be within a total voltage range of the ordinary and the extraordinary voltage ranges. Assuming that a backlight of this LCD panel is uniform, the brightness at any display unit is proportional to the transparency of the LC layer at the same display unit. A first transparency range corresponding to the aforementioned at least one ordinary voltage range may be less than a second transparency range corresponding to the aforementioned at least one extraordinary voltage range, causing the first brightness range to be less than the second brightness range.

For better comprehension, the method may be illustrated with the working flow shown in FIG. 2, but the present invention is not limited thereto. According to some embodiments, one or more steps may be added, deleted, or changed in the working flow shown in FIG. 2. For example, any (e.g. each) of the DGC module 110, the line OD module 120, and the dithering module 130 may perform parallel processing regarding all color channels, respectively, to perform the corresponding operation (e.g. the corresponding one of the operations of Steps S10, S20, and S30) for all color channels in a parallel manner.

According to some embodiments, any two (e.g. all) of multiple predetermined GC ranges respectively corresponding to the multiple color channels may be equal to each other, any two (e.g. all) of multiple predetermined line OD ranges respectively corresponding to the multiple color channels may be equal to each other, and any two (e.g. all) of multiple predetermined dithering ranges respectively corresponding to the multiple color channels may be equal to each other, but the present invention is not limited thereto. In addition, regarding the GC, respective partial GC ranges of the multiple predetermined GC ranges may be determined according to one or more predetermined settings (e.g. one or more default settings and/or one or more user settings). For example, regarding the GC, the respective partial GC ranges of at least two of the multiple predetermined GC ranges may be different from each other.

According to some embodiments, the predetermined line OD range may be equal to the predetermined GC range, and may be larger than the partial GC range of the predetermined GC range, and more particularly, a size of the predetermined GC range may be a multiple of that of a gray level range of the input image, and a size of the predetermined line OD range may be a multiple of that of the predetermined dithering range. For example, assuming that any two (e.g. all) of the multiple predetermined GC ranges are equal to each other, and that any two (e.g. all) of the multiple predetermined line OD ranges are equal to each other, and that any two (e.g. all) of the multiple predetermined dithering ranges are equal to each other, the multiple predetermined line OD ranges may be equal to the multiple predetermined GC ranges, respectively, and may be larger than the respective partial GC ranges of the multiple predetermined GC ranges, respectively, where the size of the predetermined GC range may be the multiple of that of the gray level range of the input image, and the size of the predetermined line OD range may be the multiple of that of the predetermined dithering range.

Figure 3:
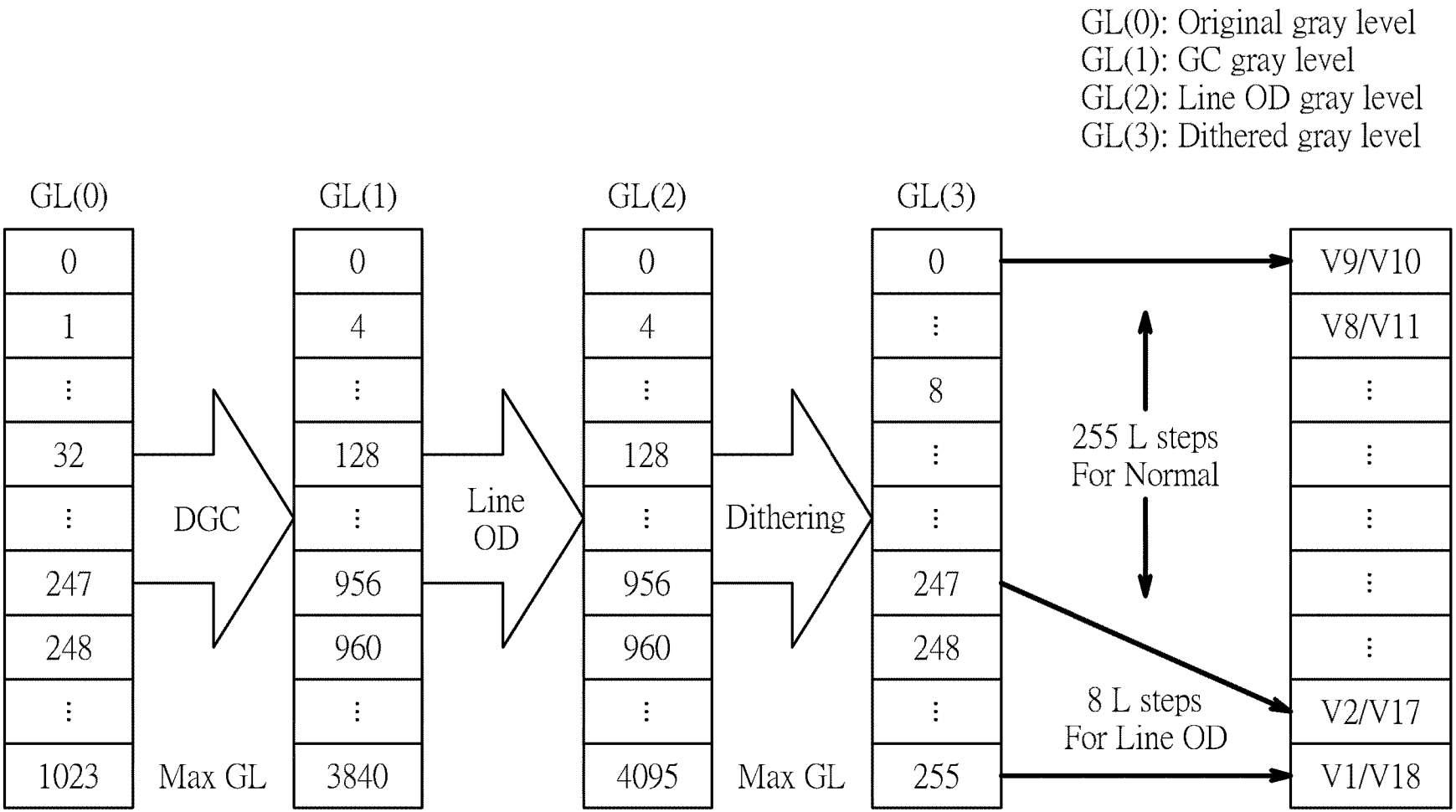
FIG. 3 illustrates an extreme brightness control scheme of the method shown in FIG. 2 according to an embodiment of the present invention.

FIG. 3 illustrates an extreme brightness control scheme of the method shown in FIG. 2 according to an embodiment of the present invention, where some of the gray levels {GL(0)}, {GL(1)}, {GL(2)} and {GL(3)}, associated operations, etc. regarding a certain color channel (e.g. the R color channel) of the multiple color channels may be illustrated for better comprehension, but the present invention is not limited thereto. Regarding said any color channel of the multiple color channels, the DGC module 110 may perform the GC on the image data of the input image to convert the image data into the gamma corrected data within the partial GC range instead of the predetermined GC range, to make room for the line OD on the predetermined line OD range, to allow the second partial data to be mapped into the aforementioned at least one extraordinary voltage range, for enhancing the brightness of the second partial data with the aforementioned at least one extraordinary voltage range.

According to this embodiment, the gray levels $\{GL_R(0)\}$, $\{GL_G(0)\}$ and $\{GL_B(0)\}$ in the image data of the input image may fall within the ranges of the intervals [0, 1023], [0, 1023] and [0, 1023], respectively, where the maximum gray level (labeled "Max GL" for brevity) may reach 1023; the gray levels $\{GL_R(1)\}$, $\{GL_G(1)\}$ and $\{GL_B(1)\}$ in the gamma corrected data of the gamma corrected image may fall within the ranges of the respective partial GC ranges of the multiple predetermined GC ranges, respectively, such as the ranges of the intervals [0, 3840], [0, 3654] and [0, 3229] corresponding to the R, the G and the B color channels, respectively, where the partial GC ranges (e.g. [0, 3840], [0, 3654] and [0, 3229]) are smaller than the multiple predetermined GC ranges (e.g. [0, 4095], [0, 4095] and [0, 4095]), respectively; the gray levels $\{GL_R(2)\}$, $\{GL_G(2)\}$ and $\{GL_B(2)\}$ in the line-OD-processed data of the line-OD-processed image may fall within the ranges of the multiple predetermined line OD ranges, respectively, such as the ranges of the intervals [0, 4095], [0, 4095] and [0, 4095], respectively; and the gray levels $\{GL_R(3)\}$, $\{GL_G(3)\}$ and $\{GL_B(3)\}$ in the dithered data of the dithered image may fall within the ranges of the multiple predetermined dithering ranges, respectively, such as the ranges of the intervals [0, 255], [0, 255] and [0, 255], respectively; but the present invention is not limited thereto.

In addition, the aforementioned at least one ordinary voltage range (e.g. one or more ordinary voltage ranges) may comprise the voltage ranges of [V17, V10] and [V9, V2], and the aforementioned at least one extraordinary voltage range (e.g. one or more ordinary voltage ranges) may comprise the voltage ranges of [V18, V17] and [V2, V1], where V1=18 Volts (V), V2=16.5 V, . . . , but the present invention is not limited thereto. According to some embodiments, the aforementioned at least one extraordinary voltage range may be further expanded, and therefore may become larger to cover more available voltage(s), where the aforementioned at least one ordinary voltage range may become smaller. As shown in FIG. 3, there may be 255 luminance steps for normal cases such as that of the first partial data (labeled "255 L steps For Normal" for brevity), and there may be 8 luminance steps for extreme line OD cases such as that of the second partial data (labeled "8 L steps For Line OD" for brevity), but the present invention is not limited thereto.

As the extraordinary voltage ranges such as [V18, V17] and [V2, V1] may be designed to cover more extreme voltages (e.g. the voltages V1 and V18 may have been further increased and decreased, respectively, and the voltages V2 and V17 may have been further increased and decreased to reach the respective original values of the voltages V1 and V18, respectively), the display module 20 may operate with a total voltage range greater than that of the architecture in the related art. Based on the architecture shown in FIG. 1, the present invention method and associated apparatus can enhance the display control regarding spatial transition between gray levels of opposite extremes, for example, by using the brightness control circuit 100C.

Figure 4:
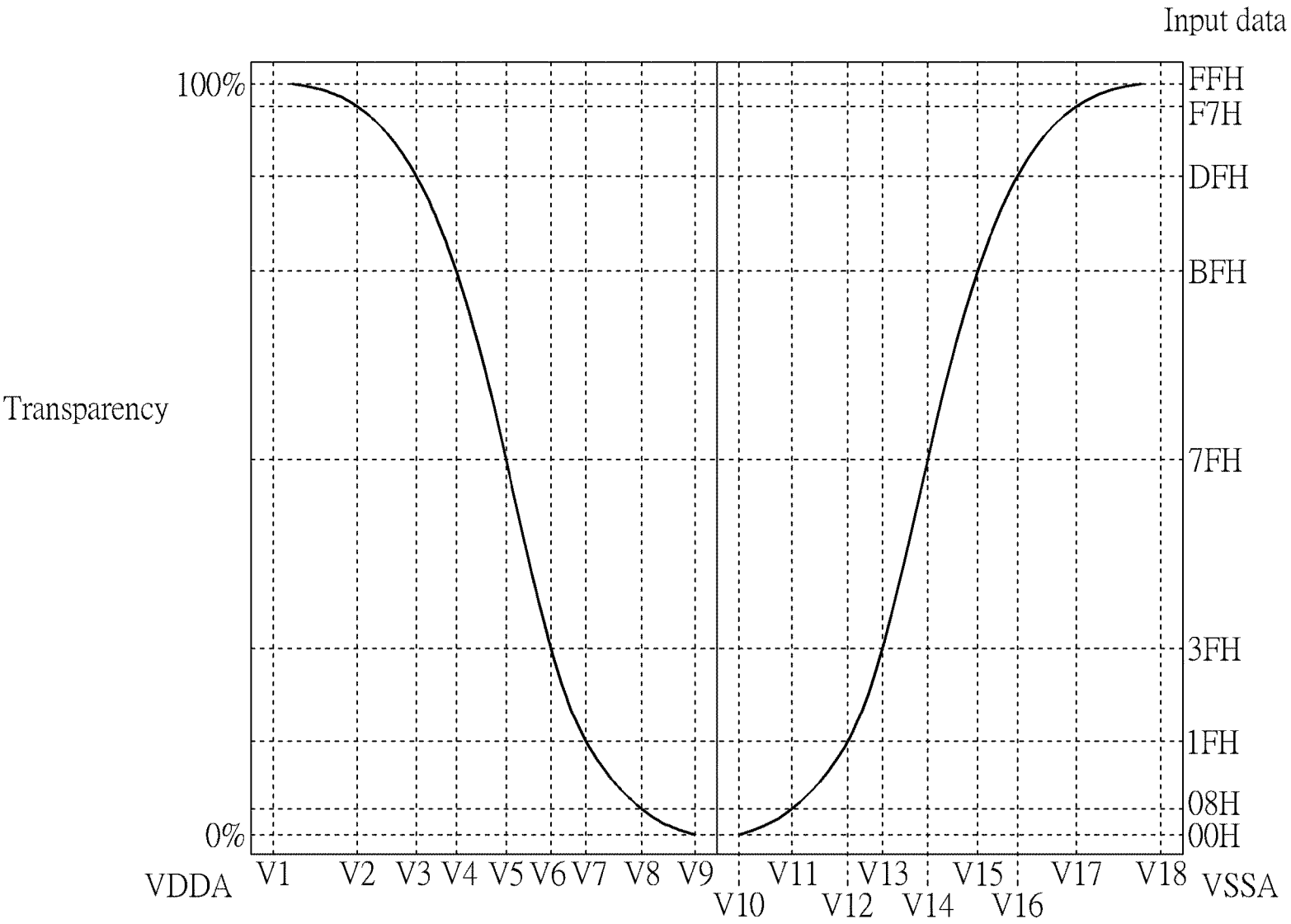
FIG. 4 illustrates some mapping relationships involved with the extreme brightness control scheme shown in FIG. 3 according to an embodiment of the present invention.

FIG. 4 illustrates some mapping relationships involved with the extreme brightness control scheme shown in FIG. 3 according to an embodiment of the present invention. The two curves in the left half and the right half of FIG. 4 may correspond to two opposite polarities associated with the voltages VDDA and VSSA of the LCD module, respectively, and an intermediate voltage between the voltages V9 and V10 may represent a common voltage (VCOM) of the LCD panel of the LCD module, but the present invention is not limited thereto. For better comprehension, the horizontal axis may represent the data voltage applied to any display unit such as that mentioned above, and the vertical axis may represent the transparency of the LC layer at this display unit (e.g. from 0% to 100%), where some possible values (e.g. hexadecimal values 00H, 08H, . . . and FFH denoted with a suffixed H) of a corresponding gray level GL(3) in the input data of the LCD panel may also be illustrated to indicate the relationships between some available voltages (e.g. V1, V2, . . . and V18) and these possible values of the corresponding gray level GL(3) in the input data. For brevity, similar descriptions for this embodiment are not repeated in detail here.

FIG. 5 illustrates a DGC range control scheme of the method shown in FIG. 2 according to an embodiment of the present invention. When there is a need (e.g. color temperature calibration, etc.), any of the respective partial GC ranges of the multiple predetermined GC ranges may be adjusted. For example, the partial GC range of the predetermined GC range corresponding to the R color channel may be adjusted to be [0, 3800], while the partial GC ranges of the predetermined GC ranges corresponding to the G and the B color channels may be kept unchanged, respectively. As a result, a portion of the mapping relationships of the GC may be changed as illustrated in the bottommost row shown in FIG. 5, where the partial GC ranges corresponding to the R, the G and the B color channels may have been changed from [0, 3840], [0, 3654] and [0, 3229] to [0, 3800], [0, 3654] and [0, 3229], respectively. For brevity, similar descriptions for this embodiment are not repeated in detail here.

FIG. 6 illustrates a two-dimensional (2D) look-up table (LUT) involved with the extreme brightness control scheme shown in FIG. 3 according to an embodiment of the present invention. The line OD module 120 may perform the line OD respectively corresponding to the multiple color channels according to at least one LUT (e.g. one or more LUTs) such as multiple 2D LUTs respectively corresponding to the R, the G and the B color channels. Taking the R color channel as an example, the line OD module 120 may perform the line OD corresponding to the R color channel according to the 2D LUT shown in FIG. 6. For better comprehension, the vertical index, the horizontal index, and the table contents of any of the multiple 2D LUTs (e.g. the 2D LUT shown in FIG. 6) may represent the current data such as a gray level Cur_sub-pixel_GL(1) of a sub-pixel (e.g. R sub-pixel) of a certain pixel in a current row of pixels within the gamma corrected image, the previous data such as a gray level Pre_sub-pixel_GL(1) of a sub-pixel (e.g. R sub-pixel) of an adjacent pixel in a previous row of pixels within the gamma corrected image, and the line OD data such as a gray level Cur_sub-pixel_GL(2) of a sub-pixel (e.g. R sub-pixel) of a corresponding pixel in a current row of pixels within the line-OD-processed image, respectively, where the gray levels Cur_sub-pixel_GL(1) and Pre_sub-pixel_GL(1) are two of the gray levels {GL(1)}, and the gray level Cur_sub-pixel_GL(2) is one of the gray levels {GL(2)}, where the line OD module 120 may obtain a mapping result (e.g. a certain table content) according to the vertical index and the horizontal index to be the gray level Cur_sub-pixel_GL(2), but the present invention is not limited thereto.

In Step S20, regarding said any color channel such as the R color channel, the timing controller 100 (e.g. the line OD module 120) may perform the line OD on the gray levels $\{GL_R(1)\}$ in the gamma corrected data to convert the gray levels $\{GL_R(1)\}$ in the gamma corrected data into the gray levels $\{GL_R(2)\}$ in the line-OD-processed data within the predetermined line OD range corresponding to the R color channel, for generating the line-OD-processed image. For example, regarding the line-OD-processing based on the 2D LUT, when the mapping result is one of the table contents in an enhancement region (e.g. a triangle-like region indicated with dashed lines) of the 2D LUT, the gray level is increased (e.g. Cur_sub-pixel_GL(2)>Cur_sub-pixel_GL(1)); when the mapping result is one of the table contents along the diagonal of the 2D LUT, the gray level is kept the same (e.g. Cur_sub-pixel_GL(2)=Cur_sub-pixel_GL(1)); and when the mapping result is one of the table contents in a remaining region of the 2D LUT, the gray level is decreased (e.g. Cur_sub-pixel_GL(2)<Cur_sub-pixel_GL(1)). Similarly, the timing controller 100 (e.g. the line OD module 120) may perform the line OD on the gray levels $\{GL_G(1)\}$ and $\{GL_B(1)\}$ in the gamma corrected data to convert them into the gray levels $\{GL_G(2)\}$ and $\{GL_B(2)\}$ in the line-OD-processed data within the predetermined line OD ranges corresponding to the G and the B color channels, respectively, for generating the line-OD-processed image. For brevity, similar descriptions for this embodiment are not repeated in detail here.

Figure 7:
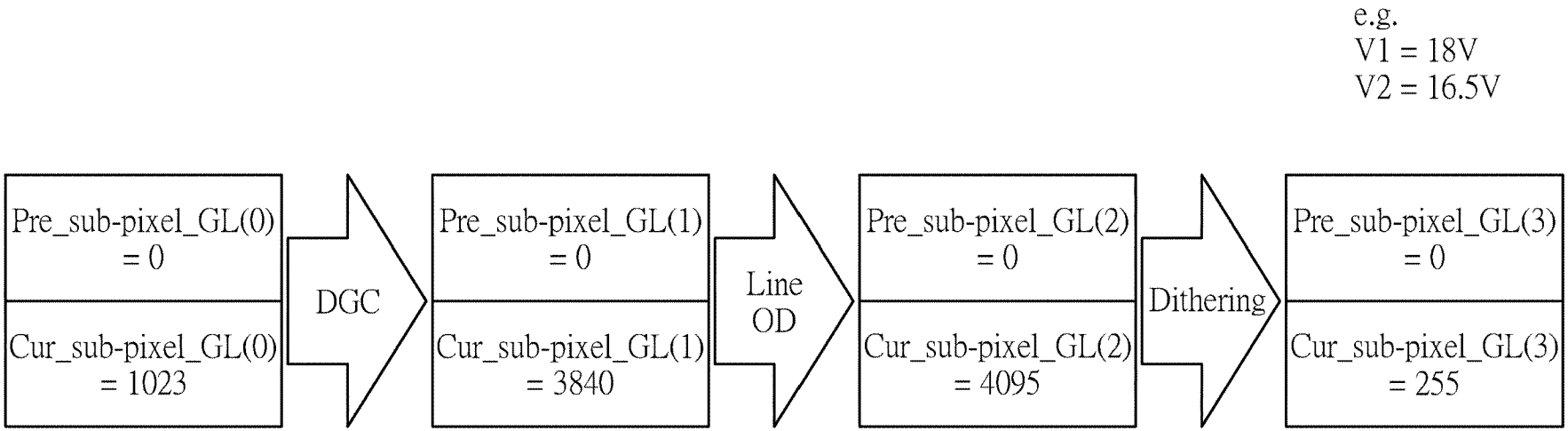
FIG. 7 illustrates an example of the associated processing of the extreme brightness control scheme shown in FIG. 3.
Figure 8:
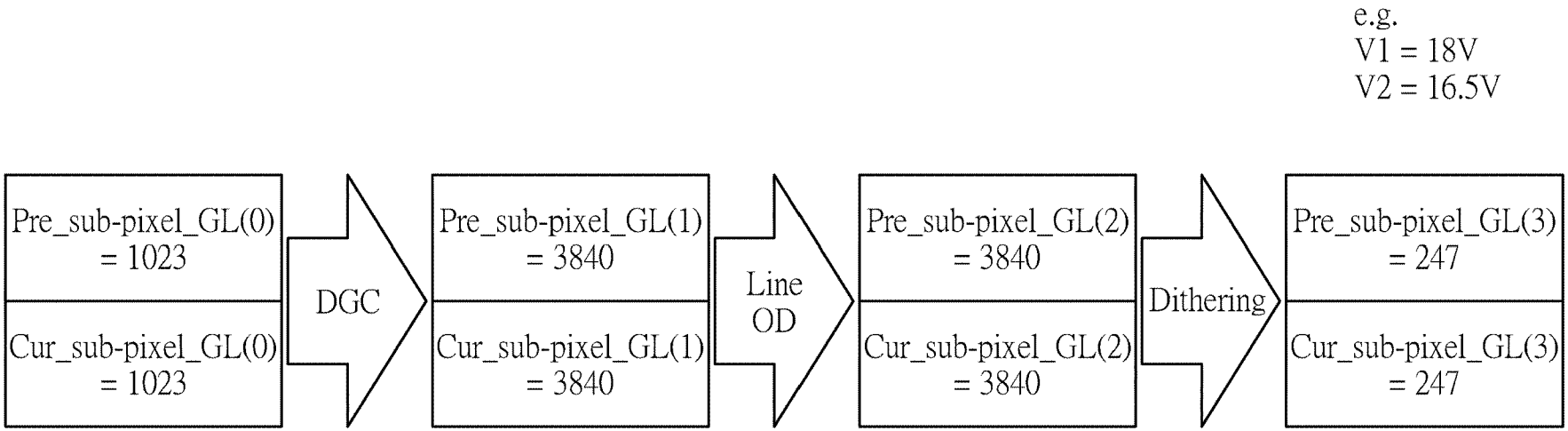
FIG. 8 illustrates another example of the associated processing of the extreme brightness control scheme shown in FIG. 3.

FIGS. 7-8 illustrate some examples of the associated processing of the extreme brightness control scheme shown in FIG. 3, where V1=18 V, V2=16.5 V, . . . , but the present invention is not limited thereto. For better comprehension, the multiple modules of the brightness control circuit 100C (e.g. the DGC module 110, the line OD module 120 and the dithering module 130) may be implemented to be one or more pipelines for performing the associated operations subsequently, but the present invention is not limited thereto. In addition, the brightness control circuit 100C may convert the gray levels {GL(0)} (e.g. Pre_sub-pixel_GL(0), Cur_sub-pixel_GL(0), etc.) into the gray levels {GL(1)} (e.g. Pre_sub-pixel_GL(1), Cur_sub-pixel_GL(1), etc.), convert the gray levels {GL(1)} (e.g. Pre_sub-pixel_GL(1), Cur_sub-pixel_GL(1), etc.) into the gray levels {GL(2)} (e.g. Pre_sub-pixel_GL(2), Cur_sub-pixel_GL(2), etc.), and convert the gray levels {GL(2)} (e.g. Pre_sub-pixel_GL(2), Cur_sub-pixel_GL(2), etc.) into the gray levels {GL(3)} (e.g. Pre_sub-pixel_GL(3), Cur_sub-pixel_GL(3), etc.) in the pipeline, where the prefixed "Cur_sub-pixel_" and "Pre_sub-pixel_" may stand for a sub-pixel of a certain pixel in a current row of pixels (such as that described above) and a sub-pixel of an adjacent pixel in a previous row of pixels (such as that described above), respectively.

Taking the R color channel as an example, when Pre_sub-pixel_GL(0)=0 and Cur_sub-pixel_GL(0)=1023, the DGC module 110 may perform the GC to make Pre_sub-pixel_GL(1)=0 and Cur_sub-pixel_GL(1)=3840, and then the line OD module 120 may perform the line OD to make Pre_sub-pixel_GL(2)=0 and Cur_sub-pixel_GL(2)=4095, and then the dithering module 130 may perform the dithering to make Pre_sub-pixel_GL(3)=0 and Cur_sub-pixel_GL(3)=255, where the gray level is increased by the line-OD-processing (e.g. Cur_sub-pixel_GL(2)>Cur_sub-pixel_GL(1)). In addition, when Pre_sub-pixel_GL(0)=1023 and Cur_sub-pixel_GL(0)=1023, the DGC module 110 may perform the GC to make Pre_sub-pixel_GL(1)=3840 and Cur_sub-pixel_GL(1)=3840, and then the line OD module 120 may perform the line OD to make Pre_sub-pixel_GL(2)=3840 and Cur_sub-pixel_GL(2)=3840, and then the dithering module 130 may perform the dithering to make Pre_sub-pixel_GL(3)=247 and Cur_sub-pixel_GL(3)=247, where the gray level is kept the same by the line-OD-processing (e.g. Cur_sub-pixel_GL(2)=Cur_sub-pixel_GL(1)). For brevity, similar descriptions for this embodiment are not repeated in detail here.

Figure 9:
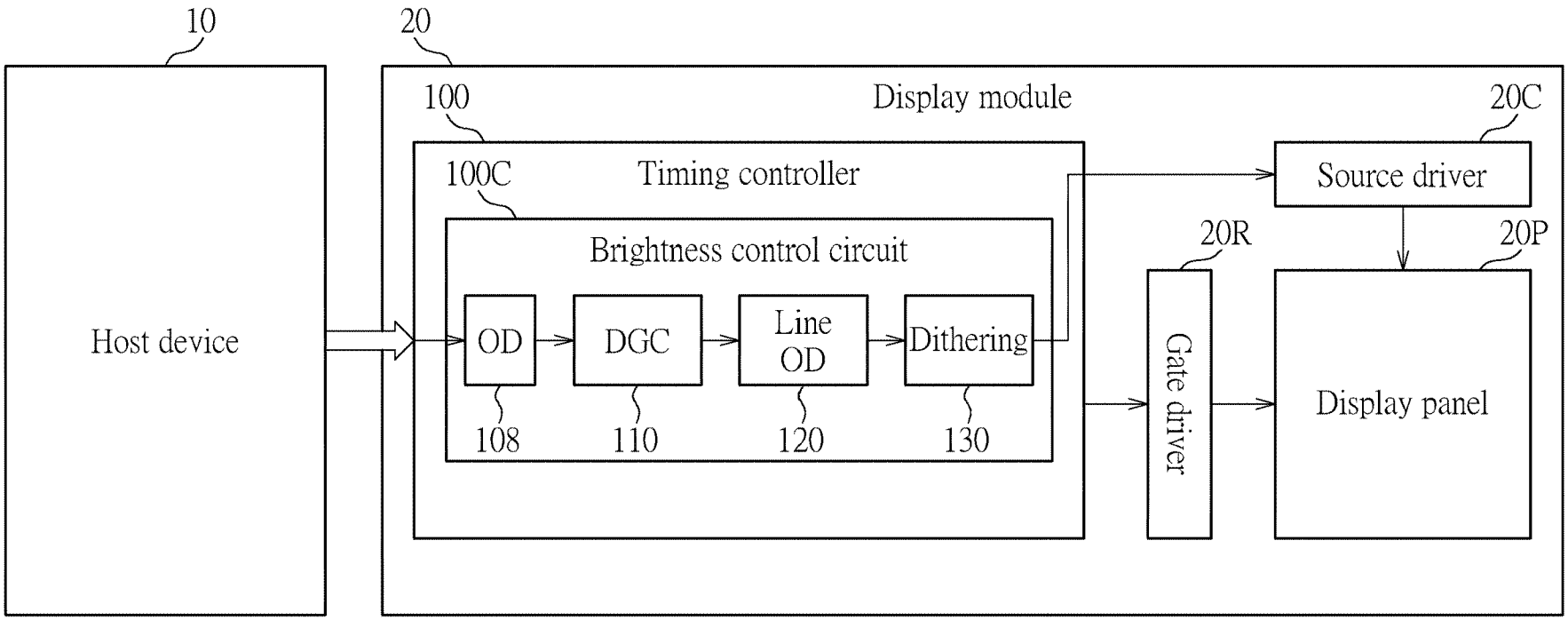
FIG. 9 illustrates additional processing of the display module according to an embodiment of the present invention.

FIG. 9 illustrates additional processing of the display module according to an embodiment of the present invention. As shown in FIG. 9, the multiple modules of the brightness control circuit 100C may further comprise a frame-based OD module 108 (labeled "OD" for brevity), and the frame-based OD module 108 may selectively perform an OD operation on a current input image according to a previous input image. For brevity, similar descriptions for this embodiment are not repeated in detail here.

According to some embodiments, the display module 20 can be configured to generate a plurality of gamma generation voltages such as the voltages V1, V2, . . . and V18, for controlling the data voltages applied to the display panel 20P through the source driver 20C. For example, the voltages V1, V2, . . . and V9 can be first polarity gamma generation voltages (e.g. the gamma generation voltages of a first polarity), and the voltages V10, V11, . . . and V18 can be second polarity gamma generation voltages (e.g. the gamma generation voltages of a second polarity opposite to the first polarity). At least one extreme voltage of the gamma generation voltages V1, V2, . . . and V18 (e.g. the extreme first polarity gamma generation voltage V1 and the extreme second polarity gamma generation voltage V18) may have been properly controlled (e.g. adjusted or optimized) to generate the aforementioned at least one extraordinary voltage range of the display panel 20P. As a result, the maximum gray level of the second partial data may correspond to at least one of the extreme first polarity gamma generation voltage and the extreme second polarity gamma generation voltage.

According to some embodiments, a gamma generation voltage control circuit within the display module 20 can be configured to control (e.g. generate or adjust) the plurality of gamma generation voltages such as the voltages V1, V2, . . . and V18, where the gamma generation voltage control circuit can be positioned outside each of the source driver 20C, the gate driver 20R, the timing controller 100, and the display panel 20P, and more particularly, can be positioned near the source driver 20C, but the present invention is not limited thereto. In some embodiments, the gamma generation voltage control circuit can be integrated into the source driver 20C.

Figure 10:
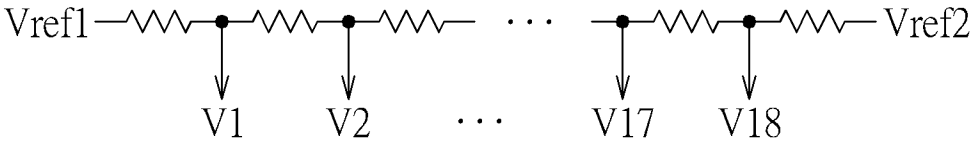
FIG. 10 illustrates an example of a gamma generation voltage control circuit within the display module.

FIG. 10 illustrates an example of the gamma generation voltage control circuit within the display module 20. The gamma generation voltage control circuit can generate the plurality of gamma generation voltages such as the voltages V1, V2, . . . and V18 according to predetermined reference voltages Vref1 and Vref2 of the display module 20 through a plurality of resistors connected in series, where one of the predetermined reference voltages Vref1 and Vref2 can be a power voltage of the display module 20, and another of the predetermined reference voltages Vref1 and Vref2 can be a ground voltage of the display module 20, but the present invention is not limited thereto. For brevity, similar descriptions for this embodiment are not repeated in detail here.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A timing controller, applicable to performing brightness enhancement in a display module, the timing controller comprising:

a brightness control circuit, comprising:

a gamma correction (GC) module, wherein regarding any color channel of multiple color channels, the GC module performs GC on image data of an input image to convert the image data into gamma corrected data within a partial GC range of a predetermined GC range corresponding to said any color channel, for generating a gamma corrected image, wherein the partial GC range is smaller than the predetermined GC range;

a line overdrive (OD) module, coupled to the GC module, wherein regarding said any color channel of the multiple color channels, the line OD module performs line OD on at least one portion of the gamma corrected data of the gamma corrected image to convert the gamma corrected data into line-OD-processed data within a predetermined line OD range corresponding to said any color channel, for generating a line-OD-processed image; and a dithering module, coupled to the line OD module, wherein regarding said any color channel of the multiple color channels, the dithering module performs dithering on the line-OD-processed data of the line-OD-processed image to convert the line-OD-processed data into dithered data within a predetermined dithering range corresponding to said any color channel, for generating a dithered image;

wherein the timing controller drives a display panel of the display module through one or more display drivers of the display module, to map first partial data and second partial data of the dithered data of the dithered image into at least one ordinary voltage range and at least one extraordinary voltage range of the display panel, respectively, for displaying the dithered image while enhancing brightness of the second partial data with said at least one extraordinary voltage range, where all gray levels of the second partial data are greater than that of the first partial data.

2. The timing controller of claim 1, wherein any two of multiple predetermined GC ranges respectively corresponding to the multiple color channels are equal to each other.

3. The timing controller of claim 2, wherein regarding the GC, respective partial GC ranges of the multiple predetermined GC ranges are determined according to one or more predetermined settings.

4. The timing controller of claim 2, wherein regarding the GC, respective partial GC ranges of at least two of the multiple predetermined GC ranges are different from each other.

5. The timing controller of claim 2, wherein any two of multiple predetermined line OD ranges respectively corresponding to the multiple color channels are equal to each other, and any two of multiple predetermined dithering ranges respectively corresponding to the multiple color channels are equal to each other.

6. The timing controller of claim 1, wherein the predetermined line OD range is equal to the predetermined GC range, and is larger than the partial GC range of the predetermined GC range.

7. The timing controller of claim 6, wherein any two of multiple predetermined line OD ranges respectively corresponding to the multiple color channels are equal to each other, and any two of multiple predetermined GC ranges respectively corresponding to the multiple color channels are equal to each other; and the multiple predetermined line OD ranges are equal to the multiple predetermined GC ranges, respectively, and are larger than respective partial GC ranges of the multiple predetermined GC ranges, respectively.

8. The timing controller of claim 7, wherein any two of multiple predetermined dithering ranges respectively corresponding to the multiple color channels are equal to each other; and a size of the predetermined GC range is a multiple of that of a gray level range of the input image, and a size of the predetermined line OD range is a multiple of that of the predetermined dithering range.

9. The timing controller of claim 6, wherein a size of the predetermined GC range is a multiple of that of a gray level range of the input image, and a size of the predetermined line OD range is a multiple of that of the predetermined dithering range.

10. The timing controller of claim 1, wherein regarding said any color channel of the multiple color channels, the GC module performs the GC on the image data of the input image to convert the image data into the gamma corrected data within the partial GC range instead of the predetermined GC range, to make room for the line OD on the predetermined line OD range, to allow the second partial data to be mapped into said at least one extraordinary voltage range, for enhancing the brightness of the second partial data with said at least one extraordinary voltage range.

11. The timing controller of claim 1, wherein the display module and the display panel represent a liquid crystal display (LCD) module and LCD panel thereof, respectively; and the one or more display drivers comprise at least one source driver, and said at least one ordinary voltage range and said at least one extraordinary voltage range are voltage ranges of data voltages provided by said at least one source driver.

12. The timing controller of claim 11, wherein at least one extreme voltage of a plurality of gamma generation voltages for controlling the data voltages has been controlled to generate the at least one extraordinary voltage range.

13. The timing controller of claim 12, wherein the at least one extreme voltage comprises an extreme first polarity gamma generation voltage and an extreme second polarity gamma generation voltage among the plurality of gamma generation voltages.

14. The timing controller of claim 13, wherein a maximum gray level of the second partial data corresponds to at least one of the extreme first polarity gamma generation voltage and the extreme second polarity gamma generation voltage.

15. The display module comprising the timing controller of claim 1, wherein the display module further comprises:

the display panel; and the one or more display drivers.

16. The display module of claim 15, wherein the display module and the display panel represent a liquid crystal display (LCD) module and LCD panel thereof, respectively; and the one or more display drivers comprise at least one source driver, and said at least one ordinary voltage range and said at least one extraordinary voltage range are voltage ranges of data voltages provided by said at least one source driver, wherein at least one extreme voltage of a plurality of gamma generation voltages for controlling the data voltages has been controlled to generate the at least one extraordinary voltage range.

17. The display module of claim 16, wherein the at least one extreme voltage comprises an extreme first polarity gamma generation voltage and an extreme second polarity gamma generation voltage among the plurality of gamma generation voltages.

18. The display module of claim 17, wherein a maximum gray level of the second partial data corresponds to at least one of the extreme first polarity gamma generation voltage and the extreme second polarity gamma generation voltage.

* * * * *